US010070711B2

(12) United States Patent
Kim

(10) Patent No.: US 10,070,711 B2
(45) **Date of Patent: *Sep. 11, 2018**

(54) COSMETIC COMPACT CONTAINER PROVIDED WITH DOME-SHAPED REFILL CONTAINER COVER

(71) Applicant: AMOREPACIFIC CORPORATION, Seoul (KR)

(72) Inventor: Jun Young Kim, Seoul (KR)

(73) Assignee: AMOREPACIFIC CORPORATION, Cheonggyecheon-Ro, Jung-Gu, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/528,313

(22) PCT Filed: Nov. 19, 2015

(86) PCT No.: PCT/KR2015/012476

§ 371 (c)(1),
(2) Date: May 19, 2017

(87) PCT Pub. No.: WO2016/085197

PCT Pub. Date: Jun. 2, 2016

(65) Prior Publication Data

US 2017/0318939 A1 Nov. 9, 2017

(30) Foreign Application Priority Data

Nov. 24, 2014 (KR) ..... 10-2014-0164120

(51) Int. Cl.
*A45D 40/22* (2006.01)
*A45D 34/00* (2006.01)
(Continued)

(52) U.S. Cl.
CPC ..... *A45D 40/221* (2013.01); *A45D 33/24* (2013.01); *A45D 34/00* (2013.01); *A45D 40/00* (2013.01);
(Continued)

(58) Field of Classification Search
CPC ..... A45C 5/005; A45C 11/008; A45D 40/00; A45D 40/22
(Continued)

(56) References Cited

U.S. PATENT DOCUMENTS 2,215,480 A * 9/1940 Sampson ..... A45D 33/006 132/306
6,609,526 B2 * 8/2003 Yuhara ..... A45D 33/003 132/307

FOREIGN PATENT DOCUMENTS

JP 09-037839 A 2/1997
KR 10-0492812 B1 8/2005
(Continued)

*Primary Examiner* — King M Chu
(74) *Attorney, Agent, or Firm* — Heedong Chae; Lucem, PC

(57) ABSTRACT

The present invention relates to a cosmetic material compact container provided with a dome-shaped refill container cover coupled to a refill container, wherein the refill container cover has a dome shape to minimize the amount of cosmetic material evaporation. Also, a sealing protrusion is provided in all directions at the bottom end of the of the refill container cover to effectively seal a cosmetic material accommodating space in the refill container, thereby allowing the cosmetic material to function effectively for a long time. In addition, a stopper protrusion is formed on a hinge-coupling part on the refill container cover and a stopper hook is formed on a hinge-coupling part on the refill container so that east fixing and coupling is enabled without requiring connection by a hinge pin, thereby reducing the
(Continued)

number of parts, and in turn, reducing manufacturing cost and man hours, and ultimately improving production quantity.

8 Claims, 6 Drawing Sheets

(51) Int. Cl.
*A45D 40/00* (2006.01)
*A45D 33/24* (2006.01)

(52) U.S. Cl.
CPC ..... *A45D 40/222* (2013.01); *A45D 2040/223* (2013.01); *A45D 2200/051* (2013.01)

(58) Field of Classification Search
USPC ..... 206/581, 823
See application file for complete search history.

(56) References Cited

FOREIGN PATENT DOCUMENTS

| | | | |
|---|---|---|---|
| KR | 10-0886430 | B1 | 3/2009 |
| KR | 10-1450113 | B1 | 10/2014 |

* cited by examiner

COSMETIC COMPACT CONTAINER PROVIDED WITH DOME-SHAPED REFILL CONTAINER COVER

CROSS-REFERENCE TO RELATED APPLICATION

This application claims the benefit of Korean application No. 10-2014-0164120, filed on Nov. 24, 2014 with the Korean Intellectual Property Office, the disclosure of which is incorporated herein by reference.

TECHNICAL FIELD

The present invention relates to a cosmetic material compact container provided with a dome-shaped refill container cover, and more specifically, to a cosmetic material compact container provided with a dome-shaped refill container cover structured so that the refill container cover is coupled to a refill container, wherein the refill container cover hats a dome shape which bulges upward so that the refill, container cover does not swell even when the cosmetic material accommodated in the refill container evaporates, so as to minimize the amount of cosmetic material evaporation. Also, a sealing protrusion is provided in all directions at the bottom end of the of the refill container cover to effectively seal a cosmetic material accommodating space in the refill container, thereby allowing the cosmetic material to function effectively for a long time. In addition, a stopper protrusion is formed on a hinge-coupling part on the refill, container cover and a stopper hook is formed on a hinge-coupling part on the refill container, when the refill container cover is connected to the refill container, so that easy fixing arid coupling is enabled without requiring connection by a hinge pin, thereby reducing the number of parts, and in turn, reducing manufacturing cost and man hours, and ultimately improving production quantity.

BACKGROUND ART

A cosmetic product refers to a product, which is used for a human body and exerts a slight effect on the human body, for cleaning and beautifying the human body to add charm, change the appearance brightly, or maintain or improve a health of a skin and a hair.

In general, the cosmetic product is manufactured by mixing cosmetic materials having different formulations using an emulsifier such, as a surfactant, and according to a mixing method, the cosmetic material may be classified into a water-in-oil type in which a water-phase material is added to an oil-phase material, and an oil-in-water type in which the oil-phase material is added to the water-phase material.

The water-in-oil type cosmetic material is obtained by mixing the oil-phase material to the water-phase material, and is oily to be slowly absorbed into a skin and heavy in use, however, has durability higher than that of the oil-in-water type, thus the cosmetic product is manufactured by using the water-in-oil type cosmetic material to improve the water resistance against sweat or water in the case of a cosmetic product requiring the durability.

In order to compensate for the heavy and sticky feeling in use of the water-in-oil type cosmetic material, the viscosity of the contents is lowered when manufacturing the water-in-oil type cosmetic material. However, when the low viscosity water-in-oil type product is stored for a long time in a container during distributions, the water-phase material of an internal phase and the oil-phase material of an external phase are sometimes separated from each other, which causes the Inconvenience in that a user has to shake the container to use a mixture of the separated water-phase material and oil-phase material.

To solve the problems described above, as shown in FIG. 1, the applicant has filed Korean Utility Model Registration No. 20-0473583 by developing a product in which low viscosity water-in-oil type contents are filled into a compact container after being impregnated into an impregnation member.

However, as in the related art, the cosmetic product having the impregnation member 4 impregnated therein with the cosmetic material has a problem in that the refill container cover 6 bulges upward according to the evaporation or volatilisation of oil and moisture of the cosmetic material when the cosmetic product is stored by covering a refill container 3 with the refill container cover 6, and the gas of the evaporated or volatilized contents escapes to the outside when the refill container cover 6 is opened to use the cosmetic material, thus when the above situation is repeated, the cosmetic material becomes hard and fails to function as the cosmetic material. Particularly, in the related art, because the refill container cover 6 is formed flat, the refill container cover 6 swells due to the evaporation or volatilization of the cosmetic material, thereby causing more cosmetic materials to be evaporated or volatilized.

Further, in the related art, the refill container cover 6 is connected with the refill container 3 through a hinge-coupling manner, so a hinge pin is used for the coupling, which causes a problem that the manufacturing cost and the number of assembling works are increased, thus the productivity is lowered.

DISCLOSURE

Technical Problem

The present invention is proposed to solve the problems described above, and the present invention provides a cosmetic material compact container provided with a dome-shaped refill container cover structured so that the refill container cover is coupled to a refill container, wherein the refill container cover has a dome shape which bulges upward so that the refill container cover does not swell even when the cosmetic material accommodated in the refill container evaporates, so as to minimize the amount of cosmetic material evaporation. Also, a sealing protrusion is provided in all directions at the bottom end of the of the refill container cover to effectively seal a cosmetic material accommodating space in the refill container, thereby allowing the cosmetic material to function effectively for a long time.

In addition, the present invention provides a cosmetic material compact container provided with a dome-shaped refill container cover structured so that a stopper protrusion is formed or a binge-coupling part on the refill container cover and a stopper hook is formed on a hinge-coupling part, on the refill container, when the refill container cover is connected to the refill container, so that easy fixing and coupling is enabled without requiring connection by a hinge pin, thereby reducing the number of parts, and in turn, reducing manufacturing cost and man hours, and ultimately improving production quantity.

Technical Solution

The present invention provides a cosmetic material compact container provided with a dome-shaped refill container, which includes: a container body (10) formed thereon with a locking groove (11); a container cover (20) hinge-coupled to the container body (10) so as to be opened and closed and formed on one side thereof with an opening/closing button (21); a refill container (30) mounted in the container body (10) and formed therein with a cosmetic material accommodating space (31); a sealing packing (50) coupled to an upper portion of the refill container (30); and a refill container cover (60) hinge-coupled to the refill container (30) so as to be opened and closed, wherein the bottom surface (62) of the refill container cover (60) bulges upward in a dome shape to prevent the refill container cover (60) from swelling even if the cosmetic material is evaporated or volatilized when the refill container cover (60) is closed to store the cosmetic material.

In addition, a mount protrusion (12) is formed inside the container body (10) and the mount protrusion (12) is mounted on a mount groove (32) formed at an outer side of the refill container (30).

In addition, an impregnation member (40) is accommodated in the cosmetic material accommodating space (31) of the refill container (30).

In addition, the refill container (30) is formed of an inner wall (34) and an outer wall (35) extending while being spaced outwardly from the inner wall (34) by a predetermined distance.

In addition, a fastening protrusion (36) is formed on an outer peripheral surface of the inner wall (34) and the fastening protrusion (36) is fastened to a fastening groove (54) formed on an inner lower portion of the sealing packing (50).

In addition, an upper extension protrusion wheel (51) is integrally formed at an upper end of the sealing packing (50) and the upper extension protrusion wheel (51) makes tight contact with a sealing protrusion (63) of the refill container cover (60).

In addition, a lower extension protrusion wheel (52) is integrally formed at a lower end of the sealing packing (50) and the lower extension protrusion wheel (52) makes tight contact with the inner wall (34) of the refill container (30).

In addition, a stopper protrusion (61) is formed at one side of the refill container cover (60) and the stopper protrusion (61) is pivotally fastened to a latch hook (33) formed at one side of the refill container (30).

In addition, a separation preventing protrusion (37) is formed on an inner peripheral surface of the latch hook (33) to prevent the stopper protrusion (61) from being separated.

In addition, a sealing protrusion (63) integrally extends from a lower end of the refill container cover (60).

Advantageous Effects

According to a cosmetic material compact container provided with a dome-shaped refill container of the present invention, the refill container cover is coupled to a refill container, wherein the refill container cover has a dome shape which bulges upward so that the refill container cover does not swell even when the cosmetic material accommodated in the refill container evaporates, so as to minimize the amount of cosmetic material evaporation. Also, a sealing protrusion is provided in all directions at the bottom end of the of the refill container cover to effectively seal a cosmetic material accommodating space in the refill container, thereby allowing the cosmetic material to function effectively for a long time.

In addition, the present invention provides a cosmetic material compact container provided with a dome-shaped refill container cover structured so that a stopper protrusion is formed on a hinge-coupling part on the refill container cover and a stopper hook is formed on a hinge-coupling part on the refill container, when the refill container cover is connected to the refill container, so that easy fixing and coupling is enabled without requiring connection by a hinge pin, thereby reducing the number of parts, and in turn, reducing manufacturing cost and man hours, and ultimately improving production quantity.

BEST MODE

Mode for Invention

One embodiment of the cosmetic material compact container provided with a dome-shaped refill container cover according to the present invention will be described as below with reference to the accompanying drawings.

Figure 2:
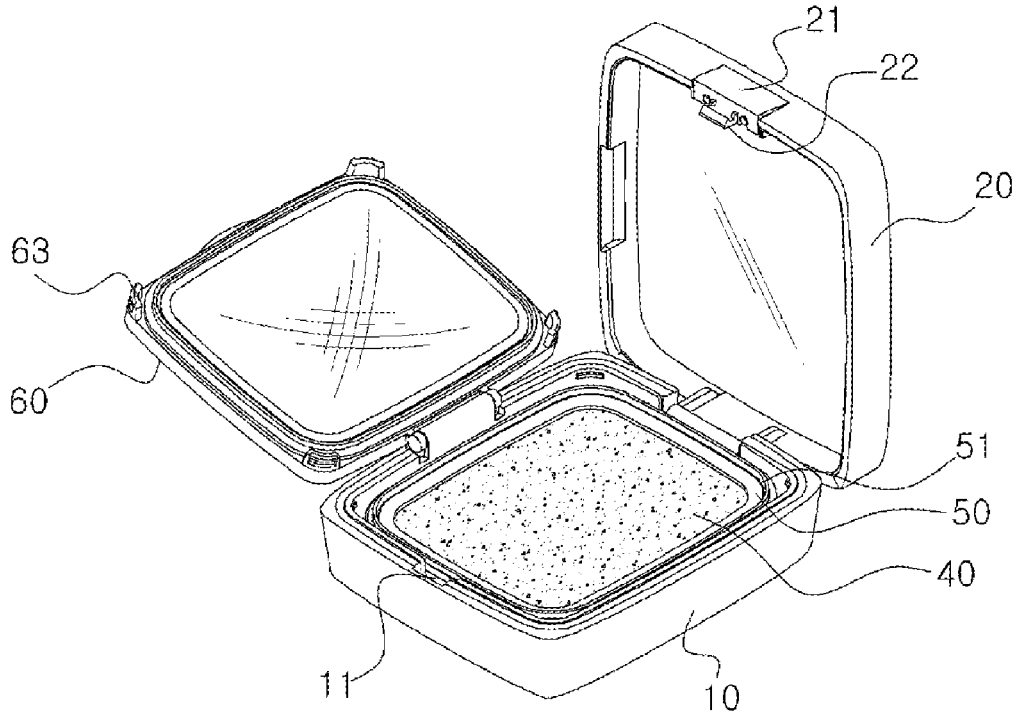
FIG. 2 is a perspective view showing a state of opening a cover of a cosmetic material compact container for a cosmetic provided with a dome-shaped refill container cover according to an embodiment, of the present invention.
Figure 3:
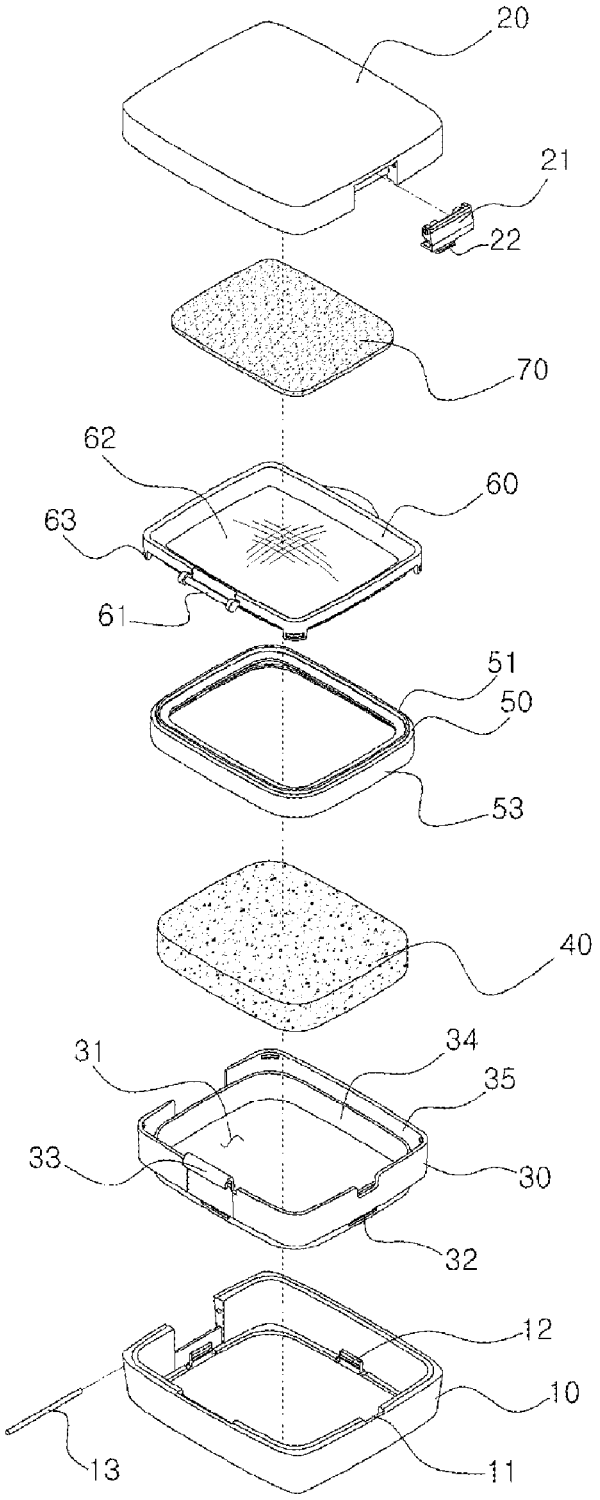
FIG. 3 is an exploded perspective view of a cosmetic material compact container provided with a dome-shaped refill container cover according to an embodiment of the present invention.
Figure 4:
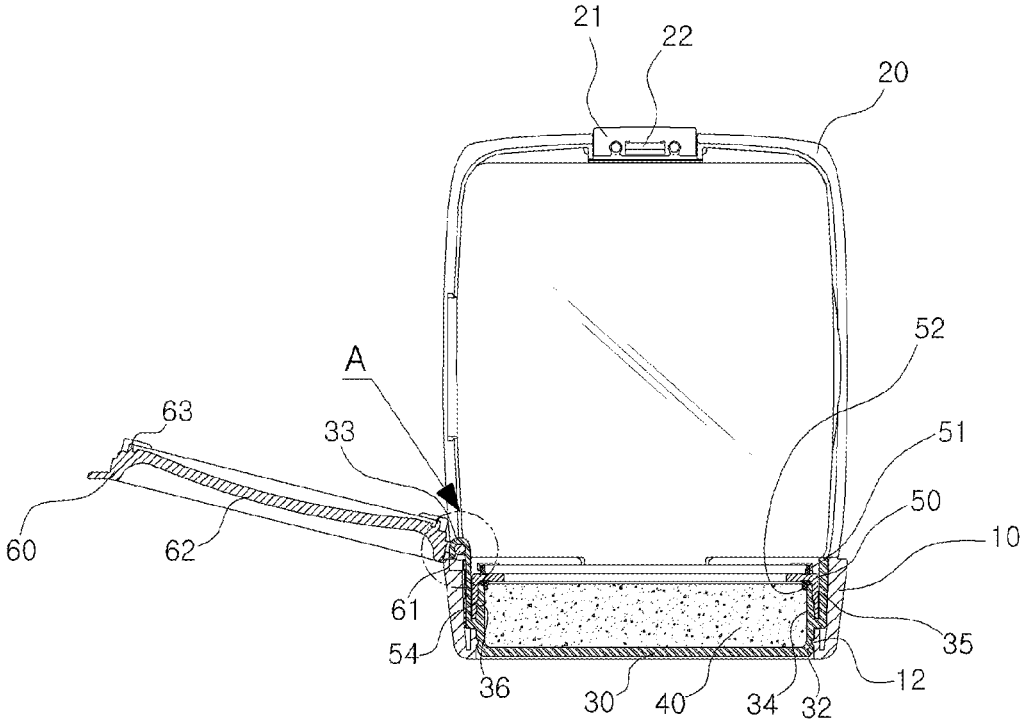
FIG. 4 is a cross sectional view showing a state of opening the refill container cover of a cosmetic material compact container provided with a dome-shaped refill container cover according to an embodiment of the present invention.
Figure 5:
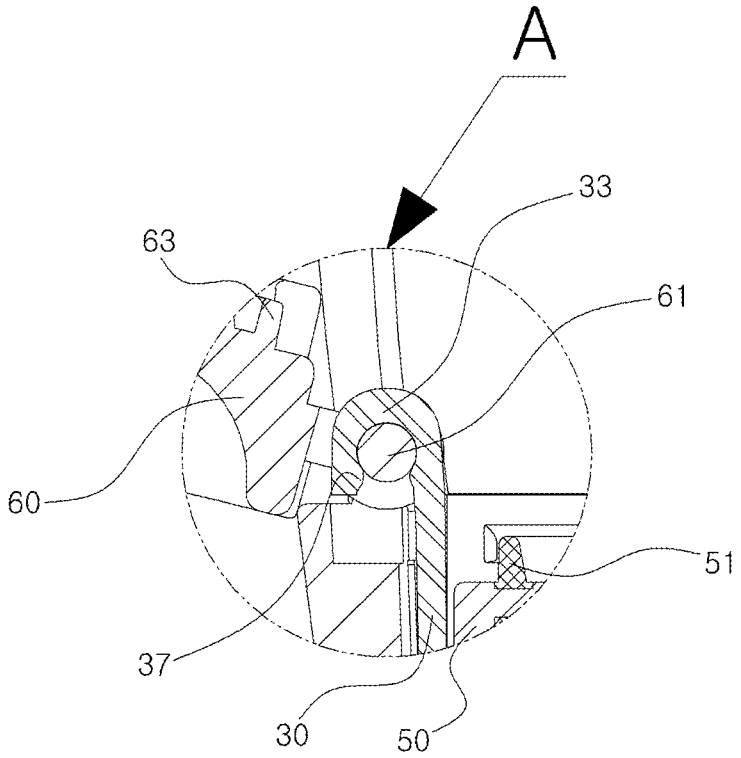
FIG. 5 is an enlarged view of a portion A in FIG. 4.
Figure 6:
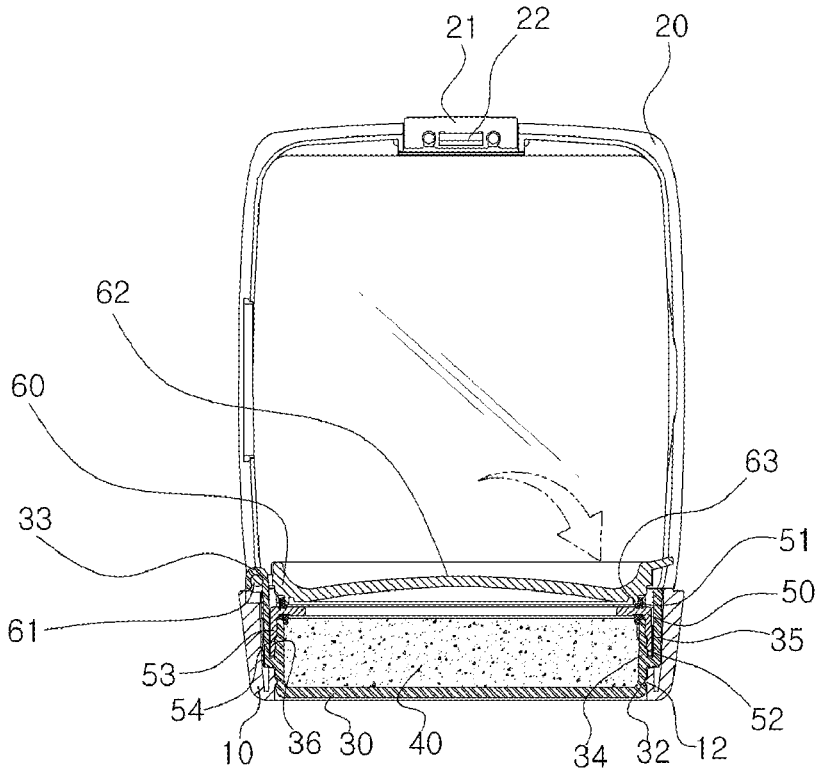
FIG. 6 is a cross sectional view showing a state of closing a refill container cover of a cosmetic material compact container provided with a done-shaped refill container cover according to an embodiment of the present invention.

FIG. 2 is a perspective view showing a state of opening a cover of a cosmetic material compact container for a cosmetic provided with a dome-shaped refill container cover according to an embodiment of the present invention. FIG. 3 is an exploded perspective view of a cosmetic material compact container provided with a dome-shaped refill container cover according to an embodiment of the present invention. FIG. 4 is a cross sectional view showing a state of opening the refill container cover of a cosmetic material compact container provided with a dome-shaped refill container cover according to an embodiment of the present invention. FIG. 5 is an enlarged view of a portion A in FIG. 4. FIG. 6 is a cross sectional view showing a state of closing a refill container cover of a cosmetic material compact container provided with a dome-shaped refill container cover according to an embodiment of the present invention.

The cosmetic material compact container provided with a dome-shaped refill container includes: a container body 10 formed thereon with a locking groove 11; a container cover 20 hinge-coupled to the container body 10 so as to be opened and closed and formed on one side thereof with an opening/closing button 21; a refill container 30 mounted on the container body 10 and formed therein with a cosmetic: material accommodating space 31; a sealing packing 50 coupled to an upper portion of the refill container 30; and a refill container cover 60 hinge-coupled to the refill container 30 so as to be opened and closed, wherein the bottom surface 62 of the refill container cover 60 bulges upward in a dome shape to prevent the refill container cover 60 from swelling even if the cosmetic material is evaporated or volatilized when the refill container cover 60 is closed to store the cosmetic material.

The container body 10 is accommodated in the middle thereof with a refill container 30, formed thereat with a locking groove 11, and formed therein with a mount protrusion 12.

A hinge is formed on a facing side of the locking groove 11 and hinge-coupled to the container cover 20 by a hinge pin 13.

The mount protrusion 12 is mounted in a mount groove 32 formed in a lower outer peripheral surface of the refill container 30 to prevent the refill container 30 from being separated from the container body 10.

The container cover 20 for covering an upper portion of the container body 10 is connected to the container body 10 in a hinge-coupled manner, and serves to open or close the container body 10.

The container cover 20 is formed at one side thereof with an opening/closing button 21 which is formed at a position corresponding to the locking groove 11 of the container body 10.

The opening/closing button 21 is formed at a lower center thereof with, a locking protrusion 22 which is formed in a shape of a protrusion so as to be latch-coupled to the locking groove 11 of the container body 10.

Figure 1:
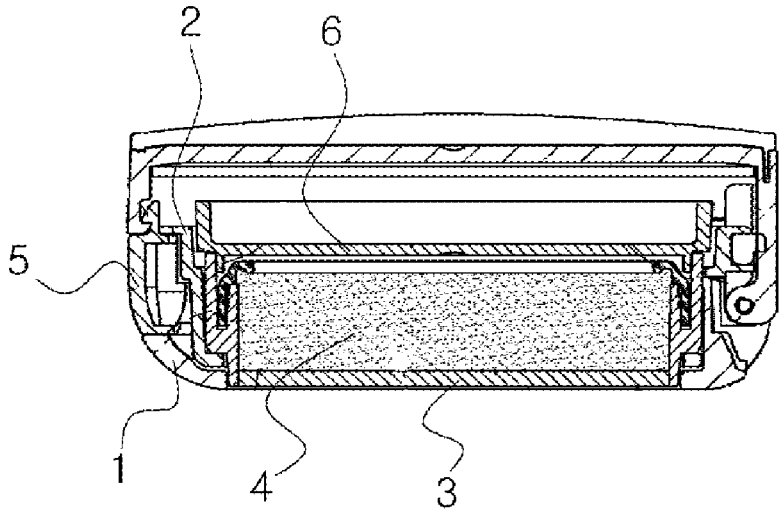
FIG. 1 is a cross sectional view of a conventional compact container.

With respect to the opening/closing button 21 formed on the container cover 20, as shown in FIG. 1, the cosmetic material accommodating space is maximized by removing an accommodating space of a push button 5 occupied in the container body 1 and removing a middle container 2 necessary for assembling the push button 5 in the related art, thus lots of cosmetic materials can be effectively refilled, thereby minimizing the inconvenience caused by frequent refill of the cosmetic material.

The refill container 30 is mounted inside the container body 10, and formed therein with the cosmetic material accommodating space 31.

The cosmetic material accommodating space 31 may be directly provided therein with the cosmetic material or mounted therein with an impregnation member 40 into which the cosmetic material is impregnated.

A coupling groove 32 is formed on a lower outer peripheral surface of the refill container 30, a latch hook 33 is integrally formed on an upper portion of the refill container 30, and an outer wall 35 is spaced outwardly from the inner wall 34 by a predetermined distance.

As shown in FIG. 4, the coupling groove 32 is coupled to the mount protrusion 12 formed on an inner side of the container body 10.

The latch hook 33 is fastened to the latching protrusion 61, in a hook latching manner, which is formed on one side of the outer peripheral surface of the refill container cover 60.

As shown in FIG. 5, a separation preventing protrusion 37 is formed on an inner peripheral surface of the latch hook 33 to prevent the latch hook from being separated.

A fastening protrusion 36 is formed on the outer peripheral surface of the inner wall 34, and the fastening protrusion 36 is fastened to a fastening groove 54 formed on a sealing packing 50 to prevent the sealing packing 50 from being separated.

The sealing packing 50 is coupled to the outer peripheral surface of the inner wall 34, formed at an upper side thereof with an upper extension protrusion wheel 51 and at a lower side thereof with, a lower extension protrusion wheel 52.

The upper extension protrusion wheel 51 and the lower extension protrusion wheel 52 are formed of an elastic rubber material, and particularly formed of at least one of natural rubber, elastomer, NBR (acrylonitrile-butadiene rubber) and silicone rubber.

The upper extension protrusion wheel 51 makes tight contact with the sealing protrusion 63 formed in the refill container cover 60 and the lower extension protrusion wheel 52 makes tight contact with the inner peripheral surface of the inner wall 34 of the refill container 30, thereby sealing the cosmetic material accommodating space 31 of the refill container 30, thus the cosmetic material is prevented from being evaporated or volatilized, so that a function of the cosmetic material can be implemented for a long time.

A lower extension part 53 laterally extends from the sealing packing 50 and a fastening groove 54 is formed on an inner peripheral surface of the lower extension part 53.

The fastening groove 54 is fastened to the fastening protrusion 36 formed on the outer peripheral surface of the inner wall 34 of the refill container 30 to prevent the sealing packing 50 from being separated from the refill container 30.

The refill container cover 60 is coupled to the refill container 30 so as to serve to open and close the refill container 30.

The refill container cover 60 is formed at one side of an outer peripheral surface thereof with a stopper protrusion 61, formed on one side thereof with a dome-shaped bottom surface 62 capable of accommodating a puff 70, and formed at a lower end thereof with a sealing protrusion 63.

The stopper protrusion 61 is fastened to the latch hook 33 formed on one side of the upper portion of the refill container 30 in a hook latching manner, thus the refill container cover 60 and the refill container 30 are fixed to each other by the hook latching manner without using a pin, thereby reducing the number of parts required for manufacturing, resulting in the reduction of the manufacturing cost.

The bottom surface 62 bulges upward in a dome shape to prevent the refill container cover 60 from swelling even when the cosmetic material is evaporated or volatilized.

The sealing protrusion 63 extends from a lower end of a corner of the refill container cover 60 and is tightly fitted and coupled to the inside of the upper extension protrusion wheel 51 of the sealing packing SO to seal the refill container 30.

An assembling method and a using state of the cosmetic material compact container provided with a dome-shaped refill container cover according to one embodiment of the present invention will be described in detail as below.

In order to assemble a cosmetic compact container provided with a dome-shaped refill container cover of the present invention, the container cover 20 is hinge-coupled to the container body 10 formed at one side thereof with the locking groove 11.

Then, the refill container 30 is mounted on the container body 10, wherein the mount protrusion 12 formed on the inner side of the container body 10 is mounted on the mount groove 32 formed on the lower outer peripheral surface of the refill container 30.

After the refill container 30 is mounted, the latch hook 33 formed at one side of the refill container 30 fastens the refill container cover 60 to the refill container 30 in the hook latching manner with the latching protrusion 61 formed on one side of the outer peripheral surface of the refill container cover 60.

At this time, the refill cover 60 bulges upward in a dome shape to prevent the refill container cover 60 from swelling even when the cosmetic material accommodated in the refill container 30 evaporates, thereby maximally reducing the amount of the cosmetic material evaporated.

The refill container 30 may be directly provided therein with the cosmetic material or mounted, therein with the impregnation member 40 into which the cosmetic material is impregnated.

Further, the assembly is completed by coupling the sealing packing 50 formed thereon with the upper extension protrusion wheel 51 and the lower extension protrusion wheel 52 onto the outer peripheral surface of the inner wall 34 of the refill container 30.

In order to use the cosmetic compact container provided with the dome-shaped refill container cover assembled by -using the method described above, the container cover 20 is opened by pressing the opening/closing button 21 formed on one side of the container cover 20.

Then, after gripping the puff 70, the refill container cover 60 is opened, and the cosmetic material accommodated in the refill container 30 is taken for use.

As shown in FIG. 6, after using the cosmetic material of the refill container 30, the refill container cover 60 is closed to seal the refill container 30.

At this time, the refill container cover 60 bulges upward in a dome shape to prevent the refill container cover 60 from swelling even when the cosmetic material accommodated in the refill container 30 evaporates, thereby maximally reducing the amount of the cosmetic material evaporated.

In addition, the sealing protrusion 63 is formed on a lower end of the refill container cover 60 to effectively seal a cosmetic material accommodating space 31 in the refill container 30, thus the cosmetic material is prevented from being evaporated or volatilized, thereby allowing the cosmetic material to effectively implement the function for a long time.

The present invention described above is just one embodiment for carrying out the cosmetic compact container provided with the dome-shaped refill container cover, and the present invention is not limited to the embodiment. As claimed in the appended claims, the present invention should be construed that it will be apparent to those having an ordinary skill in the art of the present invention in that various substitutions, deformations and modifications are available within the scope without departing from the invention.

DESCRIPTION OF REFERENCE NUMERALS

| | |
|---|---|
| 10 | container body |
| 11 | locking groove |
| 12 | mount protrusion |
| 13 | hinge pin |
| 20 | container cover |
| 21 | opening/closing button |
| 22 | locking protrusion |
| 30 | refill container |
| 31 | cosmetic material accommodating space |
| 32 | mount groove |
| 33 | latch hook |
| 34 | inner wall |
| 35 | outer wall |
| 36 | fastening protrusion |
| 37 | separation preventing protrusion |
| 40 | impregnation member |
| 50 | sealing packing |

-continued

| | |
|---|---|
| 51 | upper extension protrusion wheel |
| 52 | lower extension protrusion wheel |
| 53 | lower extension part |
| 54 | fastening groove |
| 60 | refill container cover |
| 61 | stopper protrusion |
| 62 | bottom surface |
| 63 | sealing protrusion |
| 70 | puff |

The invention claimed is:

1. A cosmetic compact container provided with a dome-shaped refill container cover, the cosmetic compact container comprising:

a container body (10) formed thereon with a locking groove (11);

a container cover (20) hinge-coupled to the container body (10) so as to be opened and closed and formed on one side thereof with an opening/closing button (21);

a refill container (30) mounted inside the container body (10) and formed therein with a cosmetic material accommodating space (31);

a sealing packing (50) coupled to an upper portion of the refill container (30); and a refill container cover (60) hinge-coupled to the refill container (30) so as to be opened and closed, wherein a bottom surface (62) of the refill container cover (60) bulges upward in a dome shape to prevent the refill container cover (60) from swelling even if the cosmetic material is evaporated or volatilized when the cosmetic material is stored by closing the refill container cover (60), and the refill container cover (60) is formed at one side thereof with a stopper protrusion (61) which is pivotally fastened to a latch hook (33) formed at one side of the refill container (30).

2. The cosmetic compact container of claim 1, wherein the container body (10) is formed at an inner side thereof with a mount protrusion (12) which is mounted on a mount groove (32) formed at an outer side of the refill container (30).

3. The cosmetic compact container of claim 1, wherein the cosmetic material accommodating space (31) of the refill container (30) is accommodated therein with an impregnation member (40).

4. The cosmetic material compact container of claim 1, wherein the refill container (30) includes an inner wall (34) and an outer wall (35) extending while being outwardly spaced from the inner wall (34) by a predetermined distance.

5. The cosmetic compact container of claim 4, wherein the inner wall (34) is formed on an outer peripheral surface thereof with a fastening protrusion (36) which is fastened to a fastening groove (54) formed on a lower inner portion of the sealing packing (50).

6. The cosmetic compact container of claim 1, wherein the sealing packing (50) is integrally formed at an upper end thereof with an upper extension protrusion wheel (51) and is integrally famed at a lower end thereof with a lower extension protrusion wheel (52).

7. The cosmetic compact container of claim 1, wherein the latch hook (33) is formed on an inner peripheral surface thereof with a separation preventing protrusion (37) for preventing the stopper protrusion (61) from being separated.

8. The cosmetic compact container of claim 1, wherein a sealing protrusion (63) integrally extends from a lower end of the refill container cover (60).

* * * * *